United States Patent [19]

Fox, Jr.

[11] Patent Number: 4,971,565

[45] Date of Patent: Nov. 20, 1990

[54] SURFACE MOUNT STACKING CONNECTOR

[76] Inventor: Roy W. Fox, Jr., 102 Christmas La., Williston, Vt. 05495

[21] Appl. No.: 442,516

[22] Filed: Nov. 28, 1989

[51] Int. Cl.[5] ..... H01R 9/09; H01R 23/72

[52] U.S. Cl. ..... 439/74; 439/83; 439/295; 439/660

[58] Field of Search ..... 439/65–67, 439/74, 75, 78, 83, 284, 292–295, 660, 676

[56] References Cited

U.S. PATENT DOCUMENTS

| | | | |
|---|---|---|---|
| 3,827,007 | 7/1974 | Fairbairn et al. | 439/293 |
| 3,868,162 | 2/1975 | Ammon | 439/75 |
| 4,133,592 | 1/1979 | Cobaugh et al. | 439/74 |
| 4,737,118 | 4/1988 | Lockard | 439/289 |
| 4,907,975 | 3/1990 | Dranchak et al. | 439/77 |
| 4,907,979 | 3/1990 | Feldman | 439/83 |

*Primary Examiner*—Neil Abrams

*Attorney, Agent, or Firm*—Chilton, Alix & Van Kirk

[57] ABSTRACT

First and second connector members extend in one direction, for example, horizontally, and include pairs of left and right hand non-conducting tenons projecting transversely from each member in another direction, e.g., vertically. Each pair of tenons forms a channel for receiving a tenon of the other member when the connection is made. Each left hand tenon carries a conductor strip which includes a resilient contact surface within the channel formed by the tenon pair, and each right hand tenon carries a right hand conductor strip including a resilient contact surface outside the channel formed by the tenon pair. Each left hand resilient contact surface is adapted to mate with a right hand resilient contact surface when the members are engaged, thereby effectuating two electrical connections between the engaged pair of tenons. Each conductor strip extends, e.g., vertically, a distance greater than the extent of the tenons in the second direction and has a second resilient conducting surface for mating with an equipment terminal or other lead outside the channel, such as a surface mount plate. Each conductor strip is preferably in the form of a vertically extending, unitary member having the conductor surface at one end, a hook at the other end for engaging an exterior ridge on a tenon, and a locking projection intermediate the strip ends for engaging a notched opening in the tenon. The conductor surface is cantilevered laterally from the conductor strip and has a stop member associated therewith the limit the flexure of the conductor surface during interaction with the contact pads of the board or plate to which the connector is mounted.

19 Claims, 6 Drawing Sheets

SURFACE MOUNT STACKING CONNECTOR

BACKGROUND OF THE INVENTION

The present invention relates to electrical connectors, and more particularly, to the type generally known as a surface mount stacking connector.

As electronic equipment of all types have incorporated digital technology and associated digital control techniques, the number of input and output signals that are desired and that require processing to implement a given control function, has grown considerably. Although the processing power of CPU'S and similar logic devices has increased while being accommodated in smaller and smaller packaging, the limits to the overall size reduction available for electronic equipment is often dictated by the connectors, by which the equipment is electronically connected to input and output signal leads. As long as a single wire is required for each input or output signal, the reduction in the physical size of the connectors is, at least in theory, limited by the volume, or cross-sectional area, of the wires to be connected to the equipment.

Although the electronics industry generally has attempted to reduce the size and complexity of connectors, such as stacking type connectors, a number of considerations make further miniaturization difficult. These considerations include assuring that each of the multiplicity of individual connections within the overall connecting members will, firstly, achieve the required mating contact, and that such contact will be uninterrupted and continuous for the required life of the equipment. Furthermore, the gross force required to simultaneously make up all the individual connections in the connector, must be reasonable and substantially evenly distributed among all the individual connections. Moreover, these considerations must be viewed in terms of the practicability of manufacturing such a connector.

SUMMARY OF THE INVENTION

It is thus an object of the present invention to provide a surface mount stacking connector with which a multiplicity of connections can easily and reliably be made in a small area.

It is a further objective that such a connector be readily manufacturable at a reasonable cost.

This is accomplished in accordance with the invention, by providing first and second connector members extending in one direction, for example, horizontally, and including pairs of left and right hand non-conducting tenons projecting transversely from each member in another direction, e.g., vertically. Each pair of tenons forms a channel for receiving a tenon of the other member when the connection is made. Each left hand tenon carries a conductor strip which includes a resilient contact surface within the channel formed by the tenon pair, and each right hand tenon carries a right hand conductor strip including a resilient contact surface outside the channel formed by the tenon pair. Each left hand resilient contact surface is adapted to mate with a right hand resilient contact surface when the members are engaged, thereby effectuating two electrical connections between the engaged pair of tenons. Each conductor strip extends, e.g., vertically, a distance greater than the extent of the tenons in the second direction and has a second resilient conducting surface for mating with an equipment terminal or other lead outside the channel, such as a surface mount plate.

The conductor strip preferably comprises an elongated central portion forming a first resilient surface displaceable transversely to the longitudinal dimension of the strip, for mating with the central portion of another such strip when the connector members are ultimately joined. The strip has a holding end extending longitudinally from the central portion and including a hook or similar profiled portion projecting transversely to the longitudinal direction of the strip, for engaging a ridge or other first profile surface on a tenon. The other, terminal end of the strip extends longitudinally from the central portion and includes a second resilient surface displaceable in the longitudinal direction of the strip, for attachment to the contact pad of a terminal plate or board after the strip has been secured to the tenon. A profiled locking projection extends transversely to the longitudinal dimension of the strip from a position between the first and second resilient surfaces, for engaging a second profiled surface on the tenon. The terminal end includes rigid stop means for limiting the deflection of the second resilient surface in the longitudinal direction, especially while the board is held against the second resilient surface during reflow soldering of the board contacts to the second resilient surfaces.

The invention in the form of a connector attached to a circuit board or the like, includes a substantially flat, horizontally oriented board containing two adjacent, left and right rows of board contacts, each contact uniformly spaced from the other contacts in a given row along a first direction and opposite a contact in the adjacent row along a second direction. A nonconducting bar member extends in the first direction and is spaced under the board contacts, the bar member having a left tenon under each board left row contact and a right tenon under each bore right row contact. The left and right tenons on the bar member project downwardly substantially in parallel to define vertical channels therebetween. A vertically oriented conductor strip is secured to each left tenon of the bar member and a vertically oriented conductor strip is secured to each right tenon of the bar member, one strip being located outside the channel and the other strip being located within the channel. The terminal end of each conductor strip extends vertically into the space between the bar member and the board, so that each strip conductor surface is in transmission contact with, and preferably soldered to, a contact pad on the board. The vertically extending stop segment limits the flexure, or vertical displacement of the conductor surface, during soldering and during the joining of one connector member to another.

The method of forming the connector includes the steps of forming unitary bars preferably having a plurality of alternating fingers and webs, each finger being longer than its adjacent web, such that portions of each web and adjacent fingers define an opening, preferably profiled. The left and right bars extend in parallel, with each web facing another web in the other bar. A conductor strip, preferably of the type described above, is first hooked at one end over a ridge or similar profile on the one end of each web, and the strip is then pushed toward an opening defined by the web such that the projection on the strip engages the profiled surface of the opening, securing the strip to the web. The terminal end of the strip containing a "J"-shaped conducting surface projects from each web. After each tenon has been fitted with a conductor strip, a board having a corresponding array of contact pads is pressed against the conductor surfaces of the strip and preferably welded thereto by reflow soldering.

With the present invention, 43 pairs of tenons, providing 86 electrical connections, can be packaged in an assembly less than 3" long by ½" wide by ½" deep.

BRIEF DESCRIPTION OF THE DRAWINGS

These and other objects and advantages of the invention will be described below with reference to the accompanying drawings, in which.

DESCRIPTION OF THE PREFERRED EMBODIMENT

Figure 1:
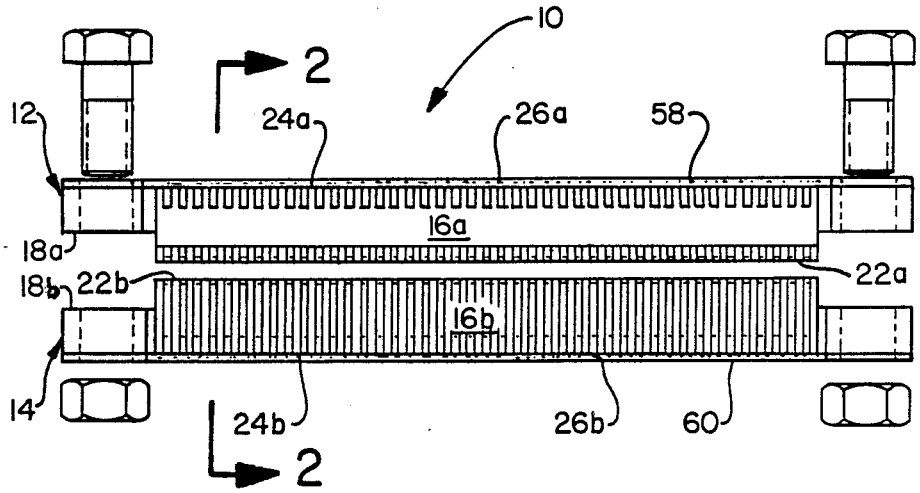
FIG. 1 is a schematic elevation view of upper and lower connector members, each of which is substantially identical.
Figure 2:
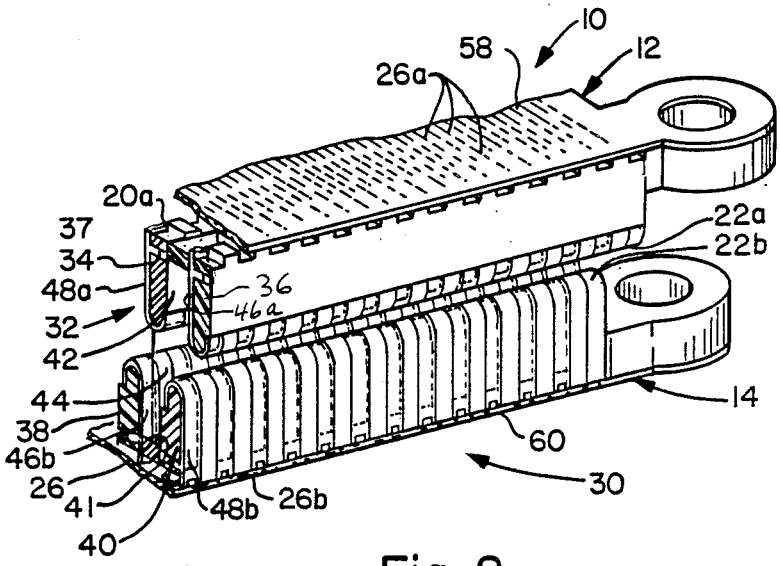
FIG. 2 is a schematic perspective view of the upper and lower connector members, taken along line 2—2 of FIG. 1.
Figure 3A:
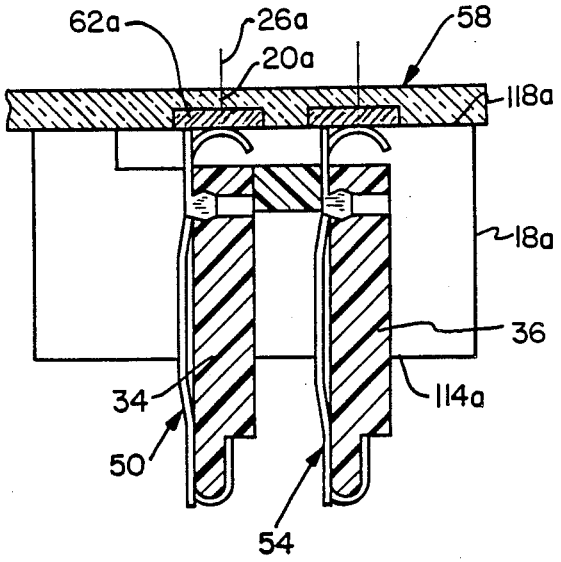
FIGS. 3*a* and 3*b* show a first embodiment of the invention, with the upper and lower connector members positioned prior to engagement therebetween.
Figure 3B:
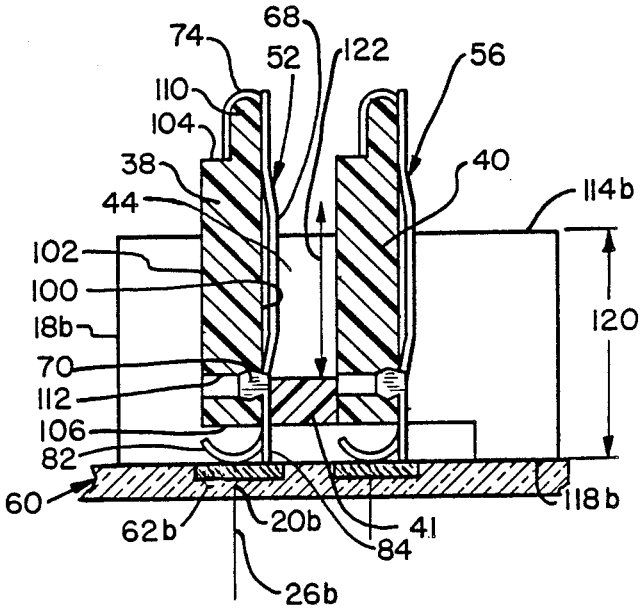

FIGS. 1 and 2 schematically show a surface mount stacking connector 10, comprising a top member 12 and bottom member 14 which, of course, could in use be oriented other than as shown in FIG. 1. Each member 12,14 is preferably identical in construction, with reference hereinafter to the top member being indicated by the suffix a and to the lower member by the suffix b. Each member has a non-conducting body portion 16*a*,16*b* and fastening means, such as rings or flanges 18*a*,18*b* at the longitudinal ends of the members. A plurality of conductor members 20*a*,20*b* are associated with the respective members 12,14, the members having a mating face 22*a*, 22*b* where the members interengage and a wire face 24*a*,24*b* where wires 26*a*, 26*b* from the equipment and/or remote sensors or the like, directly or indirectly enter the connector members 12,14.

For convenient reference, portions of the juxtaposed members 12,14 will be referred to as right side 30 and left side 32, thereby identifying left tenon 34 and right tenon 36 on top member 12, and left tenon 38 and right tenon 40 on lower member 14. In this first embodiment, base portions 37,41 extend between the tenons 34,36 and 38,40 to in part define a channel or mortise 42 on top member 12 and 44 on bottom member 14, respectively. Thus, as shown in FIG. 2, the overall appearance of the connector 10 in accordance with the invention, includes first and second juxtaposed connector members 12,14, each extending in a first, e.g., horizontal, direction and including a pair of left and right hand non-conducting tenons 34,36 and 38,40, respectively, which in turn define respective channels or mortises 42,44. One tenon 36,38 of each pair carries at least one conductor strip having a contact surface 46*a*,46*b* within a respective channel 42,44 and one tenon 34,40 of each pair carries a conductor strip 48*a*, 48*b* outside the channel formed by the pair.

If viewed independently as non-juxtaposed, identical connector members 12,14 oriented as member 14 is shown in FIG. 2, each left hand contact surface 46*a*, 46*b* is adapted to mate with a right hand contact surface 48*b*, 48*a* when the tenons 34,40 of each member are pressed into the channels 44,42 of the other member, thereby effectuating at least two electrical connections per tenon pair.

The details of the first embodiment of the invention are shown more fully in FIGS. 3–7. FIGS. 3*a* and 3*b* show face plates or circuit boards 58,60 having respective contact pads 62*a*, 62*b* to which the wires and connectors 20*a*,*b* and 26*a*,*b* are shown schematically in FIG. 2. These face plates are secured in place to form a tightly packed configuration shown in section in FIG. 4, when the top and bottom members are fastened together by means of, for example, threaded bolts passing through the rings 18.

Figure 5:
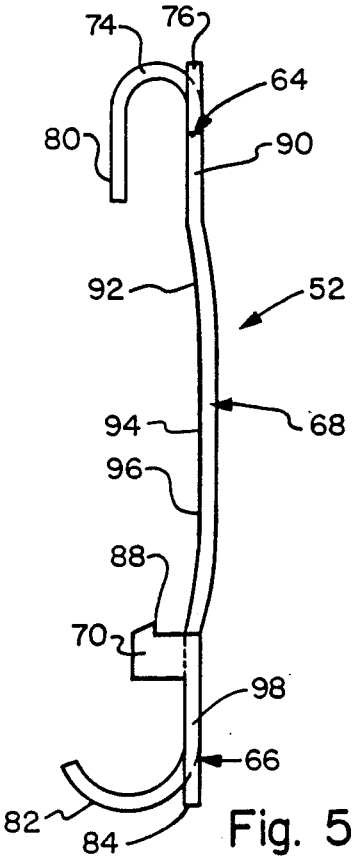
FIG. 5 is a side elevation view of one of a plurality of conductor strips associated with each conductor member of a second embodiment of the invention.
Figure 6:
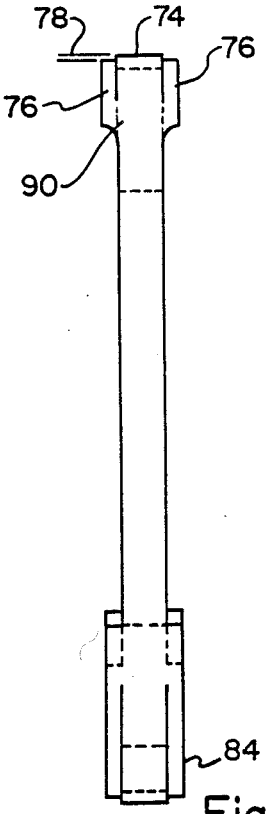
FIG. 6 is a rear elevation view of the conductor strip shown in FIG. 5.
Figure 7:
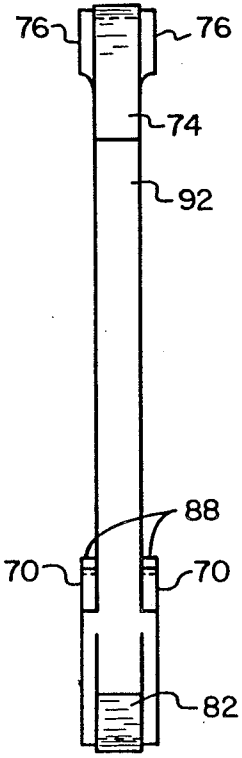
FIG. 7 is a front elevation view of the conductor strip shown in FIG. 5.

FIGS. 5–7 show the details of the preferred conductor strips such as 52, but it should be appreciated that each other strip 50, 54 and 56 is identical. The conductor strip 52 has a first end 64 and a second end 66, the entire conductor strip 52 extending a longitudinal distance greater than the extent of the respective tenons 38 to which it is attached. A resilient contact portion or surface 68 is located intermediate the ends 64,66 and is inherently biased as by bending, for slight interference contact with the intermediate contact portion of the mating strip such as 50. Between the contact portion 68 and the second end 66, a profiled locking projection 70 extends transversely to the longitudinal dimension of the conductor strip.

The first end 64 of the strip includes a hook portion 74 and a first stop segment 76, the hook 74 projecting slightly above the stop segment a distance 78. The terminus 80 of the hook portion 74 is bent approximately 180 degrees. At the other, terminal end 66 of the conductor strip 52, a convex, cantilever spring contact 82 extends in an arc of about 120 degrees and has associated therewith a second stop segment 84 which is vertically aligned with and substantially coplanar with the stop segment 76. The apex of the spring 82 projects from the stop segment 84 a distance similar to 78 at the other end of the conductor strip 52. The terminal end of the strip appears generally "J" shaped.

In the preferred embodiment, the hook 74 has a radius of curvature of approximately 0.01 inch, whereas the spring 82 has a radius of about 0.02 inch, i.e., approximately twice as large. Both hook 74 and spring 82 are formed on the same side of conductor strip 52, which side also includes the locking projection 70. The locking projection has a lip, flange, dimple or similar profile 88 for locking the conductor 52 into place on its respective tenon in a manner to be described more fully below. The projection 70 may take other forms, such as shown at 70, in FIG. 3.

Preferably, the conductor strip is a unitary piece which can be formed by stamping from a metal sheet (not shown) with the hook 74, spring 82 and locking projection 70 bent into the orientation shown in FIGS. 5–7 after cut-out from the sheet. While part of the sheet, the conductor 52 is preferably plastically deformed to define a flat head portion 90 at the first end 64 from which the hook 74 and stop segments 76 are slit, a first transition radius 92 extending from the flat portion 90 to the flat portion of the intermediate contact surface 68, the radius 92 being approximately 0.25 inch in the preferred embodiment, and another transition radius 96 of 0.175 inch in the preferred embodiment, from the inside 94 of the substantially flat contact portion 68 to the lower flat head portion 98. These radii of curvature 92,96 are on the same side of the conductor strip 52, as are the hook 74, spring 82 and projection 70. The projection 70 is located at the juncture of the flat portion 98 and the transition radius 96. As viewed in FIG. 7, the stop segments 76,84, and locking projection 70, are formed in pairs that appear to straddle the hook 74 and spring 82.

With reference again to FIGS. 3*a*, 3*b*, and 4, each tenon 38,40 in the body member 14 has a contact side 100 in channel 44, and a buffer side 102 outside the channel. Each tenon contact side 100,102 has a corresponding conductor 52,56, one of which is inside and the other of which is outside channel 44. As viewed in section, each tenon has a mating end 104 and a wire end 106, with the embodiment shown in FIG. 3*b* having a base portion 41 extending between the wire ends 106 of the pair of tenons. A ridge or similar protrusion or profile 110 extends from the mating end 104 of tenon 38,40 and has an exterior radius of curvature that is adapted to closely receive the hooks 74 of conductor strip 52,56. A recess 112 is provided near the wire side end 106 of each tenon 38 for receiving the profiled projection 70' of the conductor strip 52, thereby securing the conductor strip onto the tenon.

When secured thusly, the resilient spring 82 and associated stop segment 84 are located between wire side end 106 of the tenons and the face plate 60. The resilient spring 82 contacts the pad 62 in the face plate intimately, due to the urging of the face plates 58 and 60 toward each other and the urging of the top member 12 and bottom member 14 toward one another. In the event of excessive compression force such as might occur during reflow welding of the terminal ends to the board contact pads, the stop segments 84,76 prevent over stressing of the hook 74 such as might or spring 82. It should thus be appreciated that the ring mating surfaces 114*a*,114*b* on rings 18*a*,18*b*, respectively, will contact each other when the connector is fully assembled, and that the distance equivalent to twice the ring depth 120 is equal to the distance from the wire end stop segment 84*a*, through electrically connected conductors 50,52 and 54,56 to wire end stop segment 84*b* when assembled as shown in FIG. 4.

Figure 4:
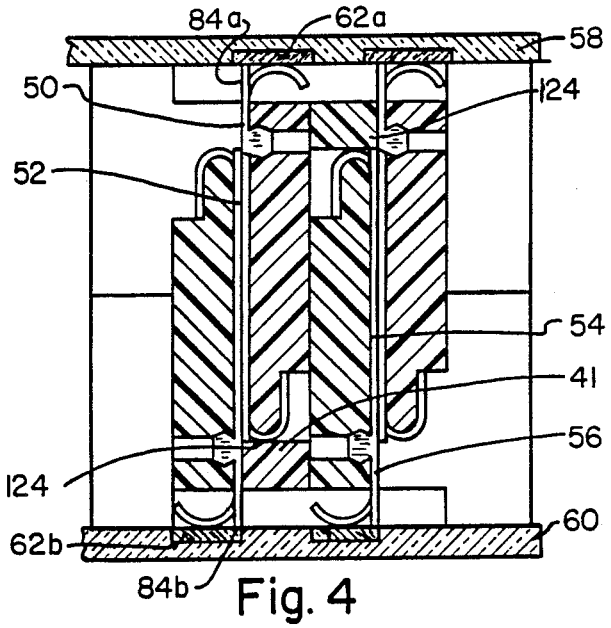
FIG. 4 shows the connector members of FIGS. 3*a* and 3*b* in the engaged position.

In the embodiment illustrated in FIGS. 3 and 4, the depth of the channel 44 is defined by the distance between the tip of the ridge 110 and the base 41. The dimensions of the tenons are such that all tolerances are taken up in the vertical direction shown in FIG. 4, from the contact pad 62*a*, through the conductor strip 50, the base 41, the conductor strip 52, and contact pad 62*b*. This is desirable in that it stiffens the conductor strips longitudinally, so that the inherently biased contact surfaces 68 will be loaded rather heavily during the engagement of the members between the relative positions shown in FIG. 3 and the assembly position shown in FIG. 4.

It should be appreciated that, as shown in FIGS. 1 and 2, each connector body extends longitudinally between the flanged or ring end portions. Each connector body is made from insulating material and is typically molded as a unitary part prior to attachment of the individual conductor strips. Initially, the tenons extend as two separate, parallel bars between the rings, without the base portion 37,41 therein. Each conductor strip is first secured by hook 74 over the protrusion 110 and the locking portion 70 is then pushed into recess 112. Base 41 is in the form of an insulating segment which is then inserted between the tenons 38,40 after all the conductor strips have been secured to their respective recesses.

In a variation of the first embodiment, the base members 37,41 have a somewhat shortened height so that a space is provided where shown at 124 in FIG. 4. In this manner, no impediment exists to the full tightening of the face plates 58,60 against the rings and each of the springs 82, although the connection itself is somewhat less rigid.

It should be appreciated that with reference to FIGS. 3 and 4, the term "tenon" indicates one leg of the generally "U" shaped connector cross section. Conductor strips 50,52 are in the same sectional plane when the connector is assembled as shown in FIG. 4, and preferably all conductor strips 50,52 and 54,56 are in the same sectional plane. Thus, two electrical connections are effectuated for a given set of mated conductor strips in the same plane.

As is evident in FIGS. 1 and 2, however, a plurality of conductor strips are preferably mounted in spaced side-by-side relation, so that all electrical connection pairs are made simultaneously, each connection pair appearing in section as shown in FIG. 4.

Figure 8:
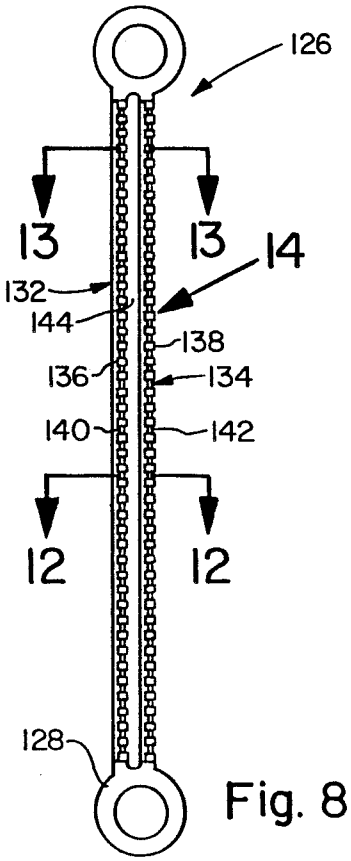
FIG. 8 is a plan view of the mating end of the connector member body in accordance with the second embodiment of the invention.

FIGS. 8–15 show a second embodiment of the invention wherein the base portion of the channel need not be provided, thus simplifying the manufacturing of each connector. These figures show only the molded insulating body part 126 including rings 128, without the attached conductor strips, except that a second conductor strip 130 is shown in phantom in FIG. 12. FIG. 8, and the section views 12—12 and 13—13 taken with respect thereto, show that each tenon bar such as 132,134 is formed by alternating larger finger-like portions 136,138 and smaller web portions 140,142. Each bar 132,134 extends independently between the connector rings for defining the channel 144 therebetween. Each short, web portion 140,142 between adjacent longer fingers 136,138 along the longitudinal direction of the web between the rings, defines a profiled opening 146,148 preferably notched as shown at 150,152, into which the locking projection 70 of a connector strip 130 can be secured. The longer finger 136,138 insulate and isolate each conductor strip 130 from the adjacent one, a plurality of which are spaced apart in the direction between the rings. As shown in FIG. 8, 43 webs and associated openings are provided on each tenon bar, thereby defining 43 pairs of tenons in the mated connector, with a resulting 86 total electrical connections.

Figure 9:
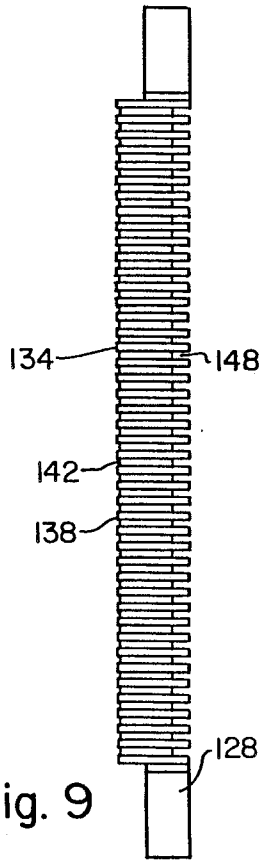
FIG. 9 is a side view of the connector member body shown in FIG. 9.
Figure 11:
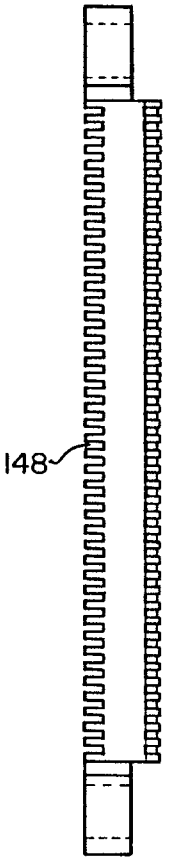
FIG. 11 is a side view of the connector member shown in FIG. 10.
Figure 10:
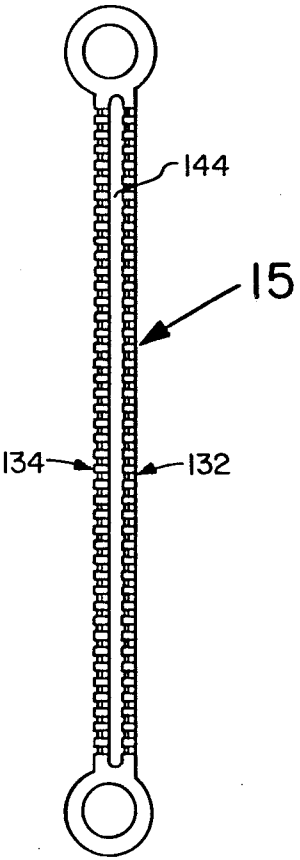
FIG. 10 is a plan view of the wire end of the connector member body shown in FIG. 1.
Figure 14:
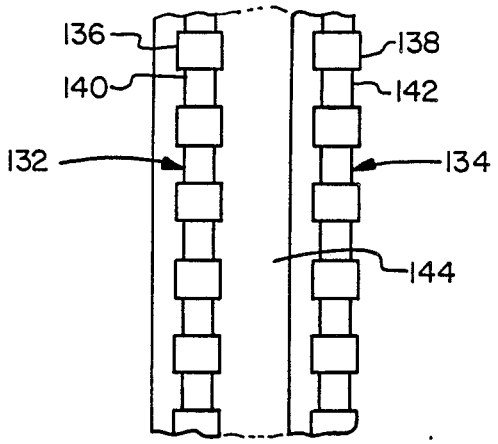
FIG. 14 is an enlarged view of a portion of the plan view shown in FIG. 8.
Figure 15:
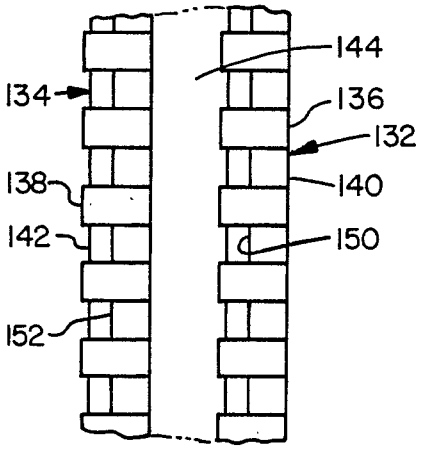
FIG. 15 is an enlarged view of a portion of the plan view shown in FIG. 10.

FIGS. 9, 10, 11, !4 and 15 show these features in different views and in different scales, for clarification.

Figure 12:
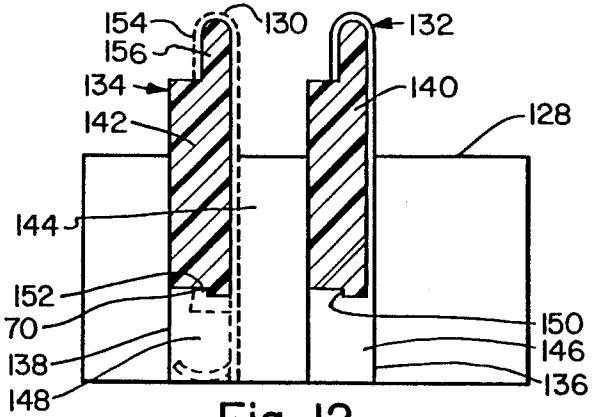
FIG. 12 is a section view of the connector member body taken along line 12—12 of FIG. 8.
Figure 13:
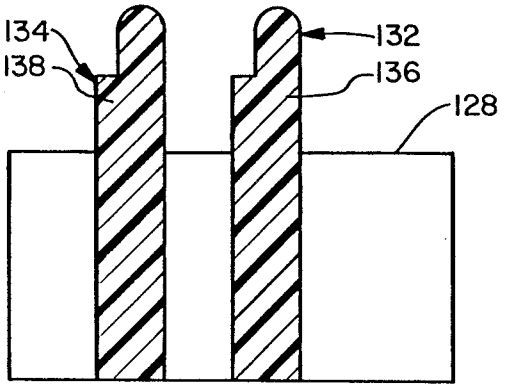
FIG. 13 is a section view of the connector member body taken along line 13—13 of FIG. 8.

It should be appreciated that in a manner similar to that described with respect to the embodiment of FIGS. 3 and 4, a conductor strip such as 130 shown in FIG. 12 is first located so that the hook 154 thereof is placed over ridge 156 on a web portion such as 142 and then the projection 70 is forced into the opening 148 and into engagement with the notch 152. There is no tenon wire side end as with the embodiment of FIG. 3, nor a base between the tenons. The distance between the hook 154 and the locking projection 70 is slightly less than the distance from the ridge 156 of the tenon to the entrance to the recess 148, whereby a modest amount of force is required to push the lip of the locking projection 70 over the notch 152 and thereby lock it into place. The sloped edges of the lip assist in overcoming the initial resistance at the entrance to the recess.

It should be appreciated that various embodiments of the bars, tenons, webs, and fingers may be provided within the spirit and scope of the present invention. In general, the term "tenon" as used herein means structure which in whole or in part defined with another tenon in a "pair", defines a channel into which another tenon may be inserted. It is possible that a given connector member could have a single right hand tenon and a single left hand tenon which define a single channel, or the connector member could have a left bar which includes a plurality of spaced apart fingers or webs, each of which serves as a tenon, and a right hand bar having a similar plurality of spaced apart fingers or webs.

I claim:

1. A stacking type electrical connector comprising:

first and second connector members, each member extending in a first direction and including at least one pair of left and right hand tenons projecting transversely from the member in a second direction, each pair of tenons forming a channel therebetween;

each left hand tenon carrying a conductor strip, including a resilient contact surface within the channel formed by the tenon pair, and each right hand tenon carrying a right hand conductor strip including a resilient contact surface outside the channel formed by the tenon pair, the right hand tenon of each member being engageable in the channel of the other member so that each left hand resilient contact surface mates with a right hand resilient contact surface when the members are engaged, thereby effectuating two electrical connections;

each conductor strip having two ends and extending in the second direction a distance greater than the extent of the tenons in the second direction, one end of each strip having a resilient conducting surface for mating with a terminal outside the channel.

2. The connector of claim 1, wherein each resilient conducting surface is spaced from its respective tenon in the second direction and cantilevered from the conductor strip in a third direction substantially perpendicular to the first and second directions.

3. The connector of claim 1, wherein each tenon is in the form of a nonconducting bar extending longitudinally in the first direction, each bar constituted from a plurality of fingers and webs which extend in the second direction and alternate in the first direction, each finger being longer in the second direction than each web, such that portions of each web and adjacent fingers define an opening extending in a third direction perpendicular to the first and second directions;

the portion of the web defining said opening includes a notch and another portion of the web remote from the notch in the second direction defines a ridge;

the conductor strip has a hook at its other end engaging the ridge, and a projection engaging the notch along the conductor strip between the two ends thereof;

whereby each conductor strip is secured to a respective web with the resilient conducting surface spaced from the notch.

4. The connector of claim 3, wherein at least a portion of the resilient conductor surface is situated in the opening.

5. The connector of claim 1, wherein each member is in the form of a substantially U-shaped nonconducting bar extending longitudinally in the first direction, one leg of the bar defining the left tenon and the other leg of the bar defining the right tenon with a base portion therebetween at one end of the legs and a channel entrance at the other end of the legs; and each tenon has a plurality of conductor strips spaced apart in the first direction, each conductor strip engaging a tenon so that said one end of the strip having the resilient conducting surface projects beyond the base from said one end of the legs.

6. The connector of claim 5, wherein said one end of each tenon includes an opening in a third direction perpendicular to the first and second directions and the the other end of the tenons includes a ridge; and each conductor strip includes a projection in the third direction near the strip one end engaging an opening in a tenon and a hook at the strip other end engaging a ridge.

7. A mated surface mount stacking connection comprising:

a substantially flat, horizontally oriented upper board containing two adjacent, left and right rows of board contacts, each contact uniformly spaced from the other contacts in a given row along a first direction and opposite a contact in the adjacent row along a second direction;

a nonconducting upper bar member extending in the first direction and spaced under the upper board contacts, the upper bar member having a left tenon under each board left row contact and a right tenon under each board right row contact, the left and right tenons on the upper bar member projecting downwardly substantially in parallel to define upper vertical channels therebetween;

a vertically oriented conductor strip secured to each left tenon of the upper bar member and a vertically oriented conductor strip secured to each right tenon of the upper bar member, the left strips located outside the upper channels and the right strips located within the upper channels;

a substantially flat, horizontally oriented lower board containing two adjacent, left and right rows of board contacts, each contact uniformly spaced from the other contacts in a given row along the first direction and opposite a contact in the adjacent row along the second direction;

a nonconducting lower bar member extending in the first direction and spaced above the lower board contacts, the lower bar member having a left tenon above each lower board left row contact and a right tenon above each lower board right row contact, the left and right tenons on the lower bar member projecting upwardly substantially in parallel to define a lower vertical channels therebetween;

a vertically oriented conductor strip secured to each left tenon of the lower bar member and a vertically oriented conductor strip secured to each right tenon of the lower bar member, the left strips located within the lower channels and the right strips located outside the lower channel;

each left tenon of the upper bar member situated in a channel of the lower bar member and each right tenon of the lower bar member situated in a channel of the upper bar member such that each conductor strip on one bar member is in transmission contact with a conductor strip on the other bar member;

each conductor strip that is secured to the upper bar member having an upper conductor surface in the space between the upper bar member and the upper board, each upper conductor surface being in transmission contact with an upper board contact;

each conductor strip that is secured to the lower bar member having a lower conductor surface in the space between the lower bar member and the lower board, each lower conductor surface being in transmission contact with a lower board contact;

whereby a transmission path is established from each left row contact on the upper board to one left row contact on the lower board, and from each right row contact on the upper board to one right row contact on the lower board.

8. The connection of claim 7, wherein each tenon has an exterior ridge and a profiled opening vertically spaced from the ridge, the opening extending in the second direction; and each conductor strip is in the form of a vertically extending, unitary member having the conductor surface at one end, a hook at the other end for engaging the exterior ridge and a locking projection intermediate the strip ends for engaging the profile of the opening.

9. The connection of claim 8, wherein each conductor strip includes a vertically oriented, rigid stop segment at least at said one end adjacent the conductor surface, for maintaining a minimum vertical separation between each bar and the respective board.

10. The connection of claim 9, wherein each conductor surface is cantilevered from a respective strip conductor in the second direction, and the stop segment limits the vertical displacement of the conductor surface resulting from contact with the board contacts.

11. The connection of claim 8, wherein each conductor strip has a vertically extending intermediate portion in transmission contact with the intermediate portion of another strip; and the hook, locking projection, and conductor surface extend in the same second direction transversely to the intermediate portion.

12. A unitary conductor strip to be secured to first and second profiled surfaces in a nonconducting tenon of a surface mount stacking connector, the strip comprising:

an elongated central portion forming a first resilient surface displaceable transversely to the longitudinal dimension of the strip, for mating with the central portion of another such strip when secured to another tenon;

a holding end extending longitudinally from the central portion and including hook means projecting transversely to the longitudinal direction of the strip, for engaging the first profiled surface of the tenon;

a terminal end extending longitudinally from the central portion and including a second resilient surface displaceable in the longitudinal direction of the strip, for attachment to the contact pad of a terminal plate after the strip has been secured to the tenon; and locking means projecting transversely to the longitudinal dimension of the strip from a position between the first and second resilient surfaces, for engaging the second profiled surface of the tenon.

13. The strip of claim 12, wherein the terminal end includes rigid stop means for limiting the deflection of the second resilient surface in the longitudinal direction.

14. The strip of claim 12, wherein the second resilient surface is cantilevered transversely to the longitudinal dimension of the strip.

15. The strip of claim 14, wherein the second resilient surface is the convex surface of a cantilevered arc.

16. The strip of claim 15, wherein the terminal end includes rigid stop means for limiting the deflection of the second resilient surface in the longitudinal direction.

17. The strip of claim 12, wherein, the central portion is substantially rectangular in length and width when projected on a horizontal plane;

the holding end and the terminal end have enlarged width dimensions relative to the central portion when projected on said horizontal plane;

the hook means is formed by a small radius bend in the longitudinal extension of the rectangular central portion, along a vertical plane perpendicular to the horizontal; first stop means are provided at the holding end in the form of two substantially straight, flat segments cantilevered longitudinally on either side of the hook means as viewed on the horizontal plane;

the second resilient surface is formed by a large radius bend in the longitudinal extension of the rectangular central portion, along a vertical plane perpendicular to the horizontal;

second stop means are provided at the terminal end in the form of two substantially straight, flat segments cantilevered longitudinally on either side of the second resilient surface means as viewed on the horizontal plane.

18. A stacking connector mounted on the surface of a circuit board, comprising:

a substantially flat, horizontally oriented upper board containing two adjacent, left and right rows of board contacts, each contact uniformly spaced from the other contacts in a given row along a first direction and opposite a contact in the adjacent row along a second direction;

a nonconducting upper bar member extending in the first direction and spaced under the upper board contact to form a first space, the upper bar member having a left tenon under each board left row contact and a right tenon under each board right row contact, the left and right tenons on the upper bar member projecting downwardly substantially in parallel to define an upper vertical channel therebetween;

a vertically oriented conductor strip secured to each left tenon of the upper bar member and a vertically oriented conductor strip secured to each right tenon of the upper bar member, the left strips located outside the upper channel and the right strips located within the upper channel;

each conductor strip including a conductor surface cantilevered laterally to the strip and soldered to a respective board contact in said first space, and means in said space first for limiting the vertical deflection of the conductor surface due to vertical interaction with the board.

19. The stacking connector of claim 18, wherein the conductor surface is formed by a radiused bend in the conductor strip and the means for limiting vertical deflection are formed by two flat segments.

* * * * *